US006073692A

United States Patent [19]

Wood et al.

[11] Patent Number: 6,073,692

[45] Date of Patent: Jun. 13, 2000

[54] EXPANDING MANDREL INFLATABLE PACKER

[75] Inventors: Edward T. Wood, Kingwood; John Lindley Baugh, Houston, both of Tex.

[73] Assignee: Baker Hughes Incorporated, Houston, Tex.

[21] Appl. No.: 09/049,303

[22] Filed: Mar. 27, 1998

[51] Int. Cl.[7] ..... E21B 33/127

[52] U.S. Cl. ..... 166/187

[58] Field of Search ..... 166/101, 184, 166/187, 206, 207, 179, 195

[56] References Cited

U.S. PATENT DOCUMENTS

| | | | |
|---|---|---|---|
| 1,634,891 | 7/1927 | Trout . | |
| 2,017,451 | 10/1935 | Wickersham . | |
| 2,583,316 | 1/1952 | Bannister . | |
| 2,593,725 | 4/1952 | Brown . | |
| 3,028,915 | 4/1962 | Jennings | 166/187 |
| 3,054,455 | 9/1962 | Keltner | 166/187 |
| 3,163,217 | 12/1964 | Haeber . | |
| 3,179,168 | 4/1965 | Vincent . | |
| 3,203,451 | 8/1965 | Vincent . | |
| 3,203,483 | 8/1965 | Vincent . | |
| 3,245,471 | 4/1966 | Howard . | |
| 3,353,599 | 11/1967 | Swift . | |
| 3,358,760 | 12/1967 | Blagg . | |
| 3,477,506 | 11/1969 | Malone . | |
| 3,489,220 | 1/1970 | Kinley . | |
| 3,710,864 | 1/1973 | Mitchell . | |
| 3,712,376 | 1/1973 | Owen et al. . | |
| 3,746,091 | 7/1973 | Owen et al. . | |
| 3,865,408 | 2/1975 | Young . | |

(List continued on next page.)

FOREIGN PATENT DOCUMENTS

| | | |
|---|---|---|
| 418056 | 3/1991 | European Pat. Off. . |
| 2258674 | 2/1993 | United Kingdom . |

OTHER PUBLICATIONS

Baker Oil Tools Fishing Services Information, 5 pages, date unknown.

Bowen Information, Composite Catalog, 1 page, date unknown.

Gotco International, Inc. Information, Composite Catalog, 1 page, date unknown.

Suman, et al., Primary cementing: Why many conventional jobs fail, reprinted from *World Oil*, 8 pages, Dec. 1982,.

*Primary Examiner*—William Neuder

*Attorney, Agent, or Firm*—Duane, Morris & Heckscher LLP

[57] ABSTRACT

An inflatable packer is disclosed involving an expandable mandrel. The mandrel is initially corrugated, creating spaces for a material which can be pushed against an inflatable element when the corrugated mandrel is expanded. The mandrel can be expanded by use of fluid or mechanical forces. The mandrel can be configured to facilitate progressive expansion. Different fluids can be used to facilitate a permanent set using a hardenable material in the annular space between the mandrel and the element. Different materials can be used so that when subjected under pressure as the mandrel is expanded, they contact each other to form a hardenable filler material. A relief mechanism is provided to allow escape of excess inflation medium in certain circumstances. The yield strength of the mandrel material can vary along its length to facilitate progressive inflation. In certain applications, the inflatable described can also expand the casing in which it is mounted. Those and other features are better understood by a review of the detailed description of the preferred embodiment below.

41 Claims, 3 Drawing Sheets

U.S. PATENT DOCUMENTS

| | | | |
|---|---|---|---|
| 3,907,034 | 9/1975 | Suman, Jr. . | |
| 3,948,321 | 4/1976 | Owen et al. . | |
| 4,483,399 | 11/1984 | Colgate . | |
| 4,501,327 | 2/1985 | Retz . | |
| 4,660,863 | 4/1987 | Bailey et al. . | |
| 4,781,249 | 11/1988 | Wood . | |
| 4,796,709 | 1/1989 | Lynde et al. . | |
| 4,830,109 | 5/1989 | Wedel . | |
| 4,897,139 | 1/1990 | Wood . | |
| 4,907,651 | 3/1990 | Bou-Mikael . | |
| 4,967,846 | 11/1990 | Wood . | |
| 4,976,322 | 12/1990 | Abdrakhmanov et al. . | |
| 5,031,699 | 7/1991 | Artynov et al. . | |
| 5,037,879 | 8/1991 | Roberts . | |
| 5,040,283 | 8/1991 | Pelgrom . | |
| 5,083,608 | 1/1992 | Abdrakhmanov et al. . | |
| 5,119,661 | 6/1992 | Abdrakhmanov et al. . | |
| 5,271,469 | 12/1993 | Brooks et al. | 166/187 |
| 5,327,962 | 7/1994 | Head . | |
| 5,333,692 | 8/1994 | Baugh et al. . | |
| 5,337,823 | 8/1994 | Nobileau . | |
| 5,348,095 | 9/1994 | Worrall et al. . | |
| 5,366,012 | 11/1994 | Lohbeck . | |
| 5,456,312 | 10/1995 | Lynde et al. . | |
| 5,494,106 | 2/1996 | Gueguen et al. . | |
| 5,667,011 | 9/1997 | Gill et al. . | |
| 5,813,459 | 9/1998 | Carisella | 166/187 |

EXPANDING MANDREL INFLATABLE PACKER

FIELD OF THE INVENTION

The field of this invention relates to application of a force to a mandrel to change its cross-sectional shape, with a result of inflating an element of the packer into a casing or borehole wall.

BACKGROUND OF THE INVENTION

Inflatable packers have numerous uses in downhole applications. They are used externally on liners to seal against a borehole wall. They are also used to isolate different zones in a wellbore for production. Inflatables can be designed for passage through tubing or can be carried on tubing or externally on a liner. In some embodiments, the inflatables are fairly lengthy, and the manner in which they inflate can be important. To this end, long inflatables have been designed which inflate progressively to ensure that the entire length of the element is seated against the casing or borehole wall. Typical of such designs are U.S. Pat. Nos. 4,781,249; 4,897,139; and 4,967,846. In these patents, the element is made in one of several unique manners to accomplish progressive inflation. One way is to change its thickness along its length or the properties of the rubber element.

Typically, inflatables of the past have been set by applied fluid pressure in the tubing or liner, or by use of straddle tools. Generally speaking, these packers would have an opening in their mandrel to allow the pressurized fluid, i.e., drilling mud or a cementitious material, to enter under pressure between the mandrel and the element for the purposes of inflation. A straddle tool seeks to straddle the opening in the mandrel so that the inflating fluid can be spotted directly into the annular space between the mandrel and the inflating element. Some disadvantages of using straddle tools relates to spillage at the conclusion of the inflating step. It is disadvantageous to have the excess inflating material remain in the wellbore, particularly if it hardens over time. Thus, circulation or reverse circulation may be necessary to remove such material from the wellbore. Another alternative is to use a material for inflation which is pushed into the annular space between the mandrel and the inflatable element by virtue of wiper plugs which are pumped downhole. Eventually, the wiper plugs are drilled out after the inflation process concludes.

These configurations for inflatable packers had several distinct disadvantages. First of all, the opening in the mandrel wall necessary to allow admission of inflation fluid presented a potential leakpath through the tubing string that supports the inflatable. Additionally, introduction of fill fluids through the tubing string created problems of cleaning out residual material. Alternatively, the drilling out of wiper plugs was also time-consuming.

The prior techniques to secure the features of progressive inflation dealt with modification of the inflatable element. These techniques were expensive and, in some cases, increased the profile of the packer, making it more difficult to use it in certain applications.

Prior designs involving openings in the mandrel also required a valving arrangement to exclude fluid from under the element until a predetermined differential pressure on the element is reached. Another technique of inflating prior packers is to run a control line down to the packer and inflate the element using the control line.

A technique of making casing patches has been developed which involves taking open-ended corrugated pipe, placing it in the wellbore, and mechanically expanding it into contact with the casing. In this technique, a segment of casing is axially corrugated. The application of a force to the corrugated casing forces it outwardly to assume the rounded shape, using forces that are below the burst pressure of the rounded tube. These applications have generally been on fairly short segments of casing, generally in the order of 10–20 ft., and have seen application exclusively as casing patches. Cross-sections, as shown in FIG. 5, have been used in making a casing patch. Homco offers a device which can expand such corrugated tubes against casing to make a short patch.

The object of the present invention employs a mandrel which is made from such corrugated tubing. In the preferred embodiment, a material is placed between the mandrel and the element such that when forces are applied to the mandrel, the intermediate fluid pushes out with the walls of the mandrel against the inflatable element. This technique eliminates openings in the mandrel wall. It further meets the objective of reducing the profile of the inflatable to facilitate its placement through small openings. The objective of progressive inflation is also accomplished by manipulation of the configuration of the mandrel. By a careful selection of the intermediary material between the mandrel and the element, a permanently set packer can be achieved. Another objective of the invention is to allow any excess applied pressure force of the inflation fluid against the element to be relieved from the annular space under the element during the expansion process of the mandrel. These and other objectives of the present invention will be made more clear from a review of the description of the preferred embodiment.

SUMMARY OF THE INVENTION

An inflatable packer is disclosed involving an expandable mandrel. The mandrel is initially corrugated, creating spaces for a material which can be pushed against an inflatable element when the corrugated mandrel is expanded or flexed into a round shape. The mandrel can be expanded by use of fluid or mechanical forces. The mandrel can be configured to facilitate progressive expansion. Different fluids can be used to facilitate a permanent set using a hardenable material in the annular space between the mandrel and the element. Different materials can be used so that when subjected to pressure as the mandrel is expanded, they contact each other to form a hardenable filler material. A relief mechanism is provided to allow escape of excess inflation medium in certain circumstances. The yield strength of the mandrel material can vary along its length to facilitate progressive inflation. In certain applications, the inflatable described can also expand the wellbore in which it is mounted. Those and other features are better understood by a review of the detailed description of the preferred embodiment below.

DETAILED DESCRIPTION OF THE PREFERRED EMBODIMENT

Figure 1:
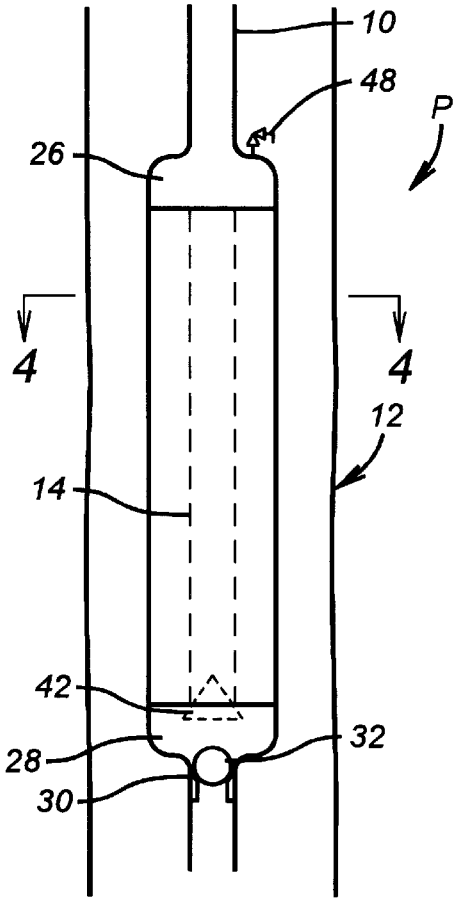
FIG. 1 is a schematic elevational view of the inflatable packer of the present invention run into position and uninflated.

Referring to FIG. 1, a tubing string 10 supports the inflatable packer P in the wellbore 12. Different configurations are envisioned for the packer P. The tubing string 10 can be a liner and the packer P an external packer on the liner which contacts a cased or uncased wellbore 12. The packer P can be a thru-tubing design such that the tubing string 10, which can be coiled tubing, passes through another string (not shown) for delivery of the packer P at the desired location in the wellbore.

Figure 4:
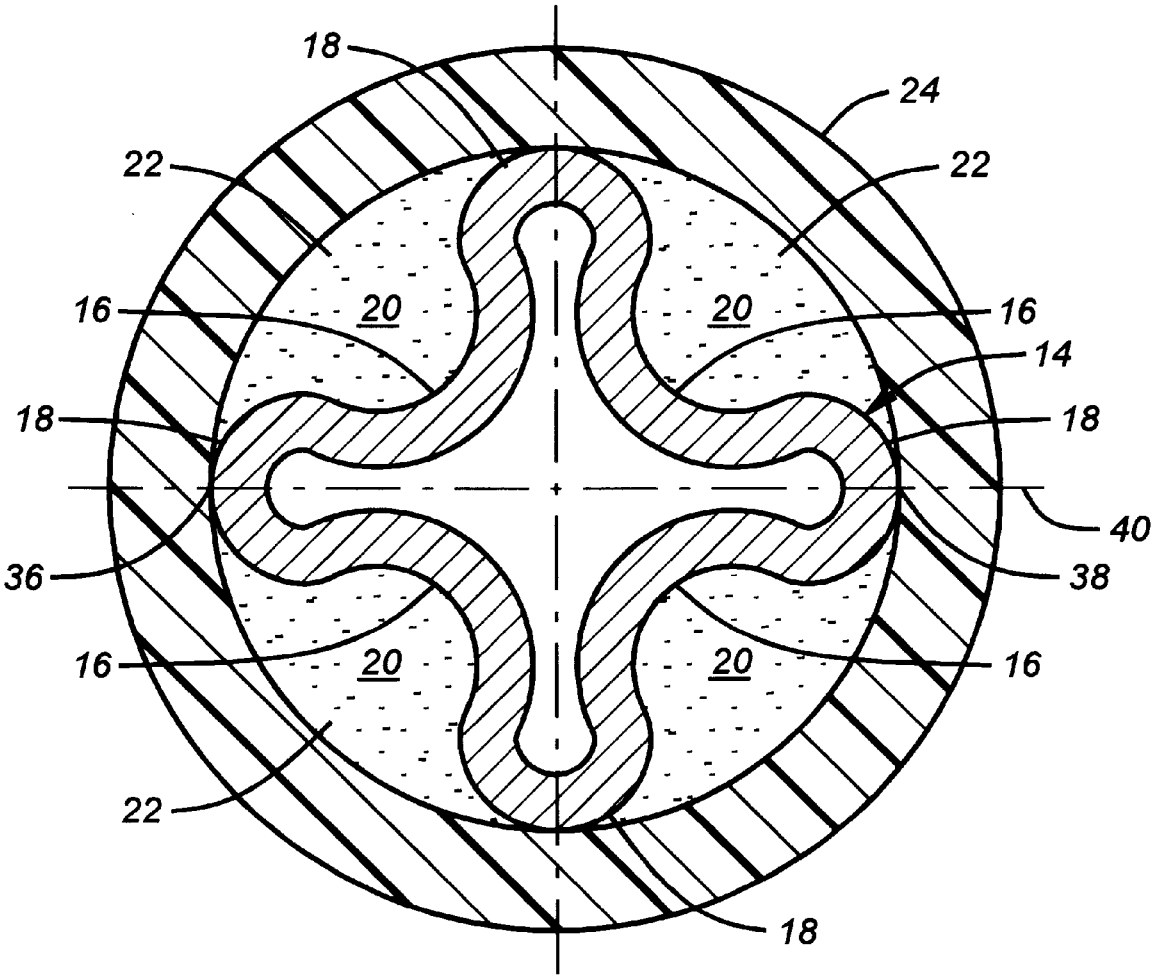
FIG. 4 is the view along lines 4—4 of FIG. 1.
Figure 5:
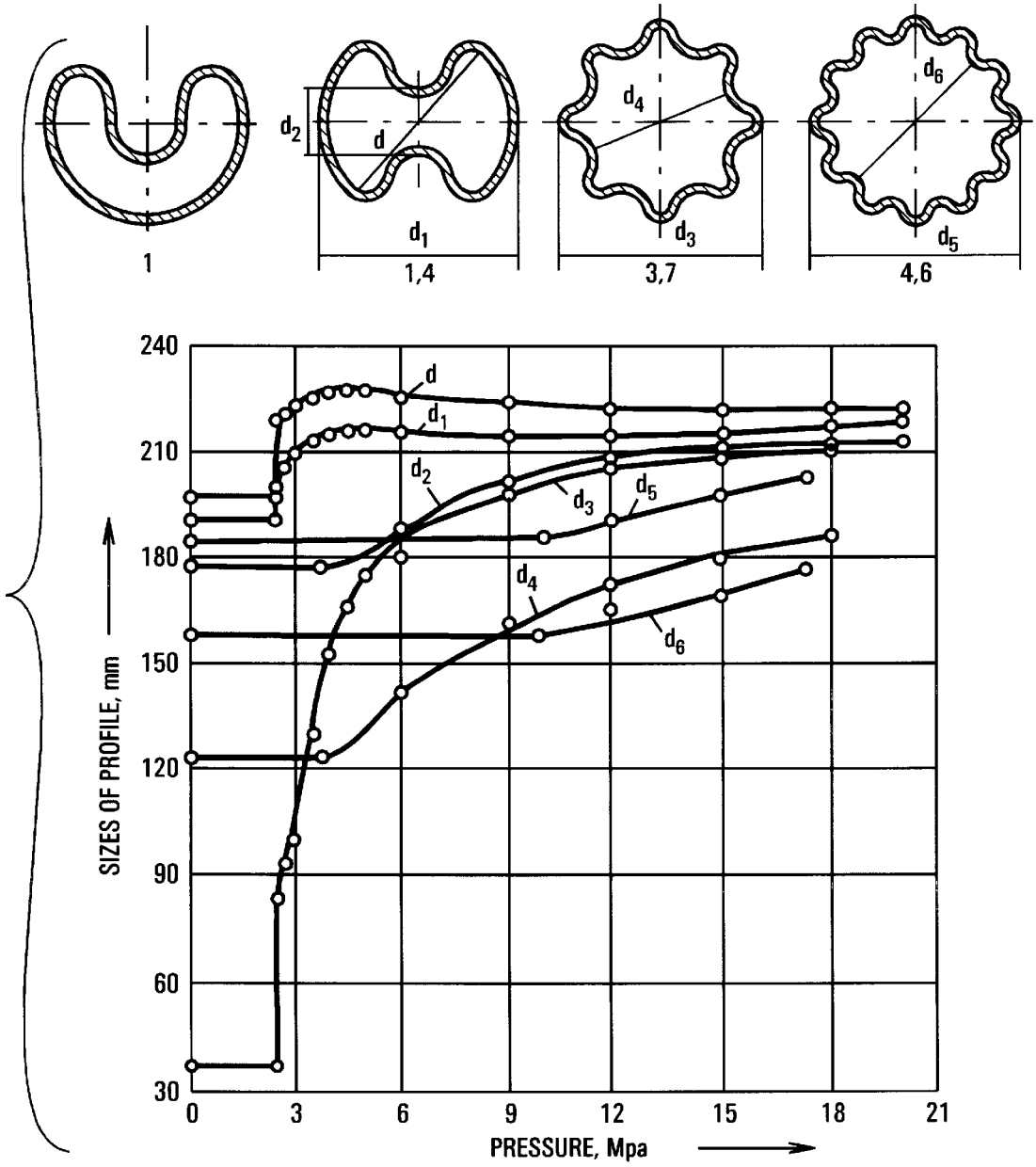
FIG. 5 is a composite showing various cross-sectional shapes of expandable mandrels and graphically illustrating below their performance with regard to amount of expansion in response to a given pressure.

The packer P has a mandrel 14 which has a generally corrugated cross-section, as shown, for example, in FIGS. 4 and 5. Thus, in one embodiment illustrated in FIG. 4, the mandrel 14 has a series of indented arcuate portions 16, each of which is between rounded peaks 18. Collectively, the indented portions 16, with the surrounding rounded peaks 18, define elongated pockets 20 which, in the preferred embodiment, can extend the axial length of the mandrel 14. Located within the pockets 20 is an inflation medium 22, while the elastomeric inflatable element 24 completes the assembly. The element 24 as shown in FIG. 1 is sealingly connected to upper and lower housings 26 and 28, respectively. An alternative embodiment allows the element 24, without the presence of inflation medium 22, to follow the profile of the peaks 18 and arcuate portions 16 for run-in. A vacuum can be pulled between the mandrel 14 and the element 24 to secure the position of the element 24 against the mandrel 14 during run-in. A relief device, such as 48, when the packer P is positioned downhole can allow wellbore fluids or other fluids from an enclosed reservoir to equalize, thus providing an inflating medium 22 before a force is applied to mandrel 14.

As an alternative, the medium 22 can be eliminated so that expansion of the mandrel 14 forces the element 24 directly against the casing or wellbore 12.

Figure 2:
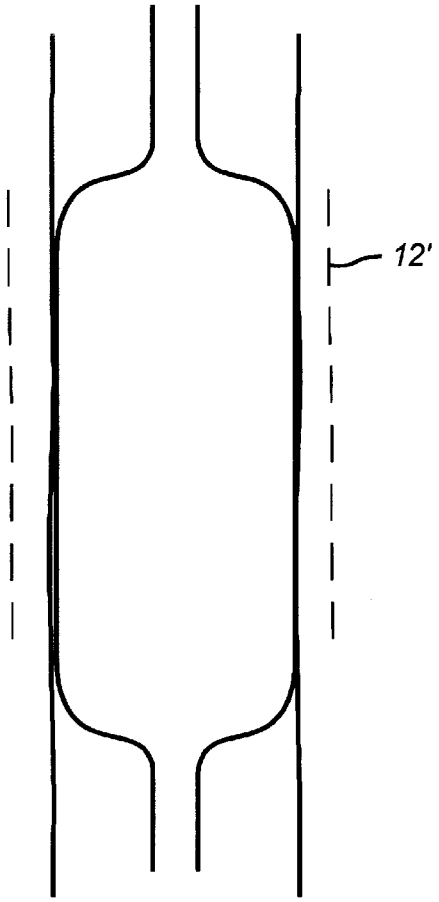
FIG. 2 is the view of FIG. 1, showing the inflated position of the packer.

Inflation of the packer P to the position shown in FIG. 2 can occur in a variety of ways. FIG. 1 illustrates schematically the presence of a ball seat 30 which can catch a ball 32 so that the interior 34 (see FIG. 4) of the mandrel 14 can be pressurized, which results ultimately in movement of the indented portions 16 outwardly until the mandrel 14 assumes a circular cross-section. This movement is a "change in cross-sectional shape," which is defined to exclude a mere size change from one round diameter to another but to include a change from, for example, a corrugated shape to a rounded shape. The inflation forces are kept below the pressure at which the mandrel 14 would rupture. It is within the scope of the invention to expand the mandrel 14 beyond the initial diameter as measured from points 36 to 38 on axis 40 so as to enhance the sealing force on the element 24 or even to expand the borehole by further resulting expansion of the mandrel 14 and element 24.

As the indented portions 16 move radially outwardly to conform the mandrel 14 to a tubular shape, the pockets 20 begin to disappear and, as a result, the inflating medium 22 displaces the element 24 radially outwardly against the casing or wellbore wall 12. As shown in FIG. 2, sufficient pressures can be applied in certain situations as, for example, in an uncased wellbore 12, where the wellbore 12 is physically expanded to a position 12'. Thus, for a specific set of configuration of wellbore 12 and dimensions for packer P, the applied force within the mandrel 14 can be sufficient to not only convert the shape of the mandrel 14 to a tubular, but to sufficiently apply forces through the element 24 to the surrounding wellbore 12 to move it to a position indicated by the dashed lines as 12'. Situations can arise where greater access is required through a piece of casing to facilitate operations further downhole. This occurs due to collapse. Should this need arise, the construction of the packer P facilitates the expansion of the collapsed portion of surrounding casing 12.

Apart from the hydraulic mechanism of changing the shape of the mandrel 14 from that shown in FIGS. 4 or 5 to a rounded tubular, mechanical techniques can also be employed. Superimposed in FIG. 1 is a schematic representation of a wedge 42 which can be used as an alternative to the ball seat 30 and ball 32 combination. The wedge 42 can be driven or pulled from below or from above. It can be pushed through the mandrel 14 or pulled through it. As opposed to a tapered wedge 42, a series of rollers defining a circular shape can also be used such that they are forced or pulled through the corrugated mandrel 14 to push it out into a circular tubular shape. The above-described techniques are merely illustrative of how to reconfigure the initial shape of the mandrel 14 shown by example only in FIGS. 4 and 5 into a circular shape for the ultimate expansion of the inflatable member 24.

One of the significant features of the mandrel 14 is that in view of the various techniques described above to convert its shape from a fluted initial shape to a circular final shape is that openings in the wall of the mandrel 14 become unnecessary. The inflation of the packer P involves the use of displacement of the inflation medium 22 through the removal of pockets 20 resulting from expansion of the mandrel 14, with the final result being the radial growth of the inflatable element 24.

It should be understood that when the packer P is in a casing 12, which has a uniform diameter throughout its length, that the growth of the packer P will be toward the inside wall of the casing 12. In certain open-hole situations or in situations with a cased wellbore where the inside dimensions of the wellbore, cased or uncased, are not uniform, the mandrel 14 can still expand to push, by virtue of the inflating medium 22, the inflatable element 24 into the irregularities of the wellbore 12. Accordingly, the fluid 22 can push element 24 into any voids formed in the wellbore or casing, even though other portions of the packer P have expanded to the point where the element 24 is up against the wellbore or casing.

Figure 3:
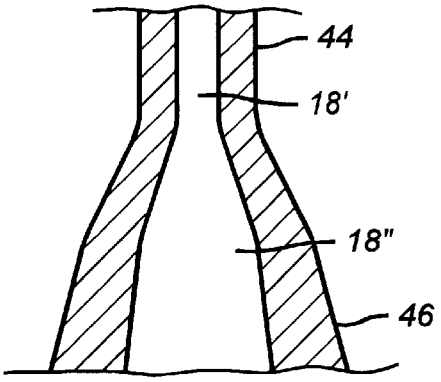
FIG. 3 is an illustration of one technique for varying the rate of expansion of the mandrel along its length by using a taper feature in the mandrel depicted.

The initial cross-sectional shape, for example, shown in FIG. 4 does not need to be uniform throughout the longitudinal length of the packer P. As shown in FIG. 3, a portion of the mandrel 14 can have different dimensions than a different portion. Thus, for example, in FIG. 3, an upper portion 44 has a smaller overall initial dimension than a lower portion 46. Illustrated in FIG. 3 to show the transition between the upper portion 44 and lower portion 46 are rounded peaks 18' and 18", which also increase in size to accommodate the tapered transition that is illustrated. The transition can be inverted. Thus, while employing any of the shapes in FIGS. 4 and 5 or other initial shapes over the length of the mandrel, changes in physical properties of the mandrel are within the purview of the invention. These physical property changes, which can include dimensional changes such as wall thickness, can have the beneficial result of controlling the rate of expansion of the inflatable element 24 in the wellbore 12. While a smooth tapered transition is shown for the mandrel 14 in FIG. 3, the changes along its longitudinal length can involve step changes. Each different portion of the mandrel 14 does not necessarily have to have the same overall configuration as a result of the step change. However, in the preferred embodiment, a smooth transition occurring along the longitudinal length is desirable to achieve growth of the element 24 from one end to the other or from the middle to both ends.

Apart from using an initial cross-sectional shape of the mandrel 14 which varies longitudinally, mandrel 14 can have different wall thicknesses along its longitudinal length, even with the same cross-sectional shape. These differences in wall thickness will also allow for progressive expansion of the element 24 when the packer P is actuated hydraulically. Thus, in this embodiment, the segments with the thinnest walls will expand first before other segments with thicker walls for the mandrel 14. The configuration of the mandrel 14 can have its thinnest components at the bottom and thickest components at the top so that it expands uniformly under hydraulic force, preferentially from the bottom to the top. The taper illustrated in FIG. 3 can also be inverted to control the direction of the progressive inflation. Alternatively, the wall thickness can be varied so that the thinnest wall section is in the center of the mandrel 14 and the wall thickness tapering up to a thicker dimension at either end. This type of design, when subjected to hydraulic pressure, will displace annular fluid 22 and element 24 from the center of the element 24 toward both ends to minimize the creation of mud channels. The same result can be achieved with changes in the configuration of the cross-sectional shape of the mandrel 14 along its length.

FIG. 5 illustrates that the different initial shapes that can be used respond at different pressures. Accordingly, by using different initial cross-sectional shapes in a single mandrel 14, different portions of the mandrel 14 will expand before others. This can be controlled to make the inflation progress in any one of a number of desired modes, such as from the top to the bottom, from the bottom to the top, and from the middle up to the top and down to the bottom. Using a uniform shape which extends the length of the mandrel 14 can dictate the pressure at which it starts to expand.

Also shown schematically in FIG. 1 is a relief valve 48, which is in fluid communication with the pockets 20 to enable excess inflation medium 22 to be displaced out of the packer P during the inflation process. This can occur when the volume of inflation medium 22 under the element 24 exceeds the annular volume between the expanded packer mandrel and the wellbore. In order to allow complete expansion, the relief valve 48 can be activated by a differential pressure as between the inflation fluid and the annulus above or below the element to allow excess inflation medium to exit. Relief valve 48 can be configured to permanently close after the element 24 is expanded. It can also be configured to be automatically closed off from the space within the inflatable 24 after a predetermined time after expansion. In short, for some applications where it is desired to expand the mandrel 14 to its fully rounded position and the shape of the wellbore 12 and its physical dimensions do not permit this to occur without creating a higih-pressure condition under the element 24, the relief mechanism 48 allows for the removal of sufficient fluid so that the mandrel 14 is allowed to expand to its fully rounded position without overpressure of element 24.

As previously described, the mechanical expansion technique involving the wedge 42 or its equivalent structure, such as a roller assembly, can be employed to expand the mandrel 14 from the top down, from the bottom to the top, or from the middle to the top or bottom.

The mandrel 14 can have differing yield strengths along its longitudinal length in conjunction with a single or multiple corrugated shape(s) such as, for example, those shown in FIGS. 4 and 5. In this situation, the sections with the lowest yield strength will respond to progressively increased pressure first for a fixed cross-section of the entire mandrel. These differing configurations of the physical properties of the mandrel material can be positioned along the longitudinal length of the mandrel so as to result in expansion of the inflatable 24 from the top down, from the bottom up, or from the middle toward the ends.

Additional operating flexibilities can be obtained from the choice of material or materials for the inflating medium 22. The inflation medium can be cement, blast furnace slag, or any other material which, alone or in combination with another material, becomes solid over time. Thus, two materials can be segregated from each other within the pockets 20 whereupon expansion of the mandrel 14, the barrier between them is broken, allowing them to mix so that they harden. Other materials can be used which, due to the applied pressure and/or temperature downhole, will set up after a predetermined time. The differing materials which, when they interact with each other, solidify can be located in adjacent pockets 20 so that they are out of fluid communication with each other until there is expansion of the inflatable 24 due to the flexing of the mandrel 14. One of the at least two ingredients which could be mixed as a result of the expansion of the mandrel 14 can be encapsulated in a membrane which breaks under the applied forces from the physical expansion of the mandrel 14 to allow mixing of the fluids underneath the inflatable element 24. Materials can be used for the inflatable medium which actually increase in volume once they mix with each other to further enhance the expansion of the inflatable element 24. When using an inflatable medium 22 which requires ingredients which are to be mixed, one of the ingredients can be segregated at or near the top or bottom of the inflatable element 24, while the other could be at the other end.

As an alternate technique for progressive inflation, a common cross-section, in combination with differing wall thicknesses, can be employed so that the thinnest segments expand before the thicker ones. Different combinations are possible which will yield the results of expansion from the top to bottom, bottom to the top, or middle to the top and bottom.

In another embodiment, the inflation medium 22 has a combination of viscosity and/or gel strength that is sufficient to generate at least 1 psi pressure loss in the inflation medium 22 per foot of length of packer P as the element 24 inflates progressively from an initial point of mandrel 14 expansion. What is desired is that the pressure in the inflation medium 22 resulting from expansion of mandrel 14 acts adjacent the point of casing 12 expansion. Thus, for every foot of axial distance from the point of mandrel 14 expansion, the pressure acting to expand the element 24 is decreased by at least 1 psi. As a result of using this type of material, localized forces expand the mandrel 14 and element 24 locally rather than the built-up pressure in the medium 22 causing element movement at a remote location to the region where the mandrel 14 is expanding. Using a viscous material or a gel will help to ensure that localized forces from mandrel 14 result preferentially in localized expansion of the element 24 to also facilitate progressive inflation.

The inflation material 22 can also be encapsulated in an impermeable membrane or vessel. The material 22 can be selected such that a mixture of ingredients occurs in a controlled or delayed manner after mixing. The medium 22 itself, even if made up of more than one constituent, can, as a result of such mixing, physically expand beyond the forces applied to it from growth of the mandrel 14.

Other choices for use of a single or multi-component inflation medium, apart from cementitious materials and blast furnace slag, can be two-part or heat-activated resins. In the preferred embodiment, phenolic resins are the material of choice. When sand-like particles are forced together with grain-to-grain loading, the sand will become hard. An analogy is the hardness of coffee in vacuum-pack bags. Therefore, sand-like particles can be used as an inflation medium; also sand with phenolic coating (super sand).

FIG. 5 illustrates that for different sizes the shapes, the growth occurs at different pressures.

It should also be considered within the purview of the invention to incorporate the use of drilling mud for the inflatable medium 22. One technique for doing this can be an evacuation of the pockets 20, which will result in the element 24 conforming to the shape of the mandrel 14 for run-in. When the packer P is properly located, a one-way valve (which can be a part of valve 48) can be actuated to admit, by equalization, wellbore fluids into pockets 20 prior to the application of force internally at 34 to the mandrel 14. Thus, the relief valve 48 can be configured for a multipurpose application so that in this particular embodiment, it will allow drilling mud to enter while at the same time allow it to escape again if a predetermined pressure is reached within the inflatable 24 as the mandrel 14 is being expanded.

Progressive inflation can also be achieved using a mandrel such as 14 in combination with specially made elements 24 in the manner as described in U.S. Pat. Nos. 4,781,249; 4,897,139; and 4,967,846, whose teachings are incorporated herein as if fully set forth. For example, the element 24 can have differing thicknesses, modulus, or other physical restraints on portions thereof so as to allow for progressive inflation.

The foregoing disclosure and description of the invention are illustrative and explanatory thereof, and various changes in the size, shape and materials, as well as in the details of the illustrated construction, may be made without departing from the spirit of the invention.

What is claimed:

1. A downhole packer to seal against a tubular or a borehole wall, comprising:

a body, further comprising a mandrel, said mandrel having a cross-sectional shape that can change in response to applied force;

a sealing element mounted to said mandrel;

whereupon application of force to said mandrel causes said cross-sectional shape to change as said sealing element is moved into contact with the tubular downhole or the borehole wall.

2. A downhole packer to seal against a tubular or a borehole wall, comprising; a body, further comprising a mandrel, said mandrel having a cross-sectional shape that can change in response to applied force;

a sealing element mounted to said mandrel;

whereupon application of force to said mandrel causes said cross-sectional shape to change as said sealing element is moved into contact with the tubular downhole or the borehole wall; and an inflation material located between said mandrel and said sealing element such that a cross-sectional shape change of said mandrel pushes said inflation material against said sealing element.

3. The packer of claim 2, wherein:

said mandrel is configured to allow for progressive inflation of said sealing element.

4. The packer of claim 3, wherein:

said sealing element having upper and lower ends;

said mandrel is configured to change cross-sectional shape in a manner that expands said sealing element from said lower to said upper end.

5. The packer of claim 3, wherein:

said sealing element has upper and lower ends;

said mandrel is configured to change cross-sectional shape in a manner that expands said sealing element from said upper to said lower end.

6. The packer of claim 3, wherein:

said sealing element has upper and lower ends;

said mandrel is configured to change cross-sectional shape in a manner that expands said sealing element from between said upper and lower ends toward said upper and lower ends.

7. The packer of claim 3, wherein:

said mandrel comprises a plurality of initial cross-sectional shapes along its length.

8. The packer of claim 3, wherein:

said mandrel comprises a change in wall thickness over its length.

9. The packer of claim 3, wherein:

said mandrel comprises a material or materials along its length where the yield strength of said mandrel changes along its length.

10. The packer of claim 7, wherein:

said mandrel has an initial shape that varies in dimension due to at least one tapered segment thereon.

11. The packer of claim 2, wherein:

said mandrel is indented to define at least one pocket between itself and said sealing element.

12. The packer of claim 11, wherein:

said pocket defined by said mandrel decreases in volume in response to an applied force within said mandrel.

13. The packer of claim 12, wherein:

said mandrel comprises a plurality of pockets which decrease in volume as an applied force within said mandrel forces it toward a round cross-section.

14. The packer of claim 13, wherein:

said mandrel, in response to an applied force, eliminates all said pockets and assumes a round cross-section.

15. The packer of claim 2, wherein:

said mandrel, in response to a force within, displaces said inflation material and said sealing element with sufficient force against the borehole wall so as to alter the dimension of the borehole wall.

16. The packer of claim 2, further comprising:

a pressure-release device to allow said inflation material to pass from between said mandrel and said sealing element upon a predetermined pressure therein.

17. The packer of claim 16, wherein:

said pressure-release device is isolated after a predetermined force is applied on said mandrel to drive said sealing element into contact with the tubular downhole or the borehole wall.

18. The packer of claim 16, wherein:

said pressure-release device is isolated after a predetermined time after a force is applied to change the cross-sectional shape of said mandrel.

19. The packer of claim 2, further comprising:

a pressure-equalization device to allow selective equalization of flow of wellbore fluids into between said mandrel and said sealing element to serve as said inflation material prior to application of a force to said mandrel.

20. The packer of claim 2, wherein:

said mandrel is expanded mechanically.

21. The packer of claim 2, wherein:

said mandrel is expanded hydraulically.

22. The packer of claim 14, wherein:

said mandrel is expanded from its bottom to its top.

23. The packer of claim 14, wherein:

said mandrel is expanded from its top to its bottom.

24. The packer of claim 14, wherein:

said mandrel is expanded from between its bottom and top toward its bottom and top.

25. The packer of claim 2, wherein:

said inflation material comprises a plurality of ingredients which are brought into contact as a result of said cross-sectional shape change.

26. The packer of claim 25, wherein:

said ingredients mix to harden said material.

27. The packer of claim 26, wherein:

said inflation material expands in volume due to said mixing.

28. The packer of claim 25, wherein:

said mandrel defines a plurality of longitudinally extending pockets;

said ingredients located in tubes disposed in said pockets, which tubes open up upon application of force to said mandrel to promote said mixing.

29. The packer of claim 25, wherein:

at least one of said ingredients is encapsulated with said encapsulation failing in response to applied force on said mandrel to promote said mixing.

30. The packer of claim 25, wherein:

one of said ingredients is segregated from another ingredient in an initial position adjacent one end of said mandrel.

31. The packer of claim 2, wherein:

said inflation material comprises a cementitious material.

32. The packer of claim 26, wherein:

said ingredients react and at least one of said ingredients regulates the rate of reaction of other ingredients.

33. The packer of claim 2, wherein:

said sealing element is configured in a manner to promote progressive inflation.

34. The packer of claim 33, wherein:

said element comprises an elastomeric material whose modulus of elasticity changes along its length.

35. The packer of claim 33, wherein:

said sealing element comprises an elastomeric material whose thickness varies along its length.

36. The packer of claim 33, further comprising:

a releasable confining agent on a segment of said sealing element, said element comprising an elastomer.

37. The packer of claim 33, wherein:

said sealing element comprises rubber cured differently along its length.

38. The packer of claim 34, wherein:

said sealing element is constructed of rubber having different characteristics from end to end.

39. The packer of claim 2, wherein:

said inflation material comprises a substance which does not readily transfer a pressure increase, due to a force applied from said mandrel when said mandrel expands, to portions of said element remote from the point of application of force from said mandrel.

40. The packer of claim 14, wherein:

said mandrel continues to increase in dimension due to an applied force after initially assuming said rounded cross-section.

41. The packer of claim 2, wherein:

said material comprises particles that have compressive strength when forced together.

* * * * *